US011831079B2

(12) United States Patent
Meyer et al.

(10) Patent No.: US 11,831,079 B2
(45) Date of Patent: Nov. 28, 2023

(54) CIRCUIT BOARD FOR RADAR SENSORS HAVING A METALLIC FILL STRUCTURE, AND METHOD FOR PRODUCING A CIRCUIT BOARD FOR RADAR SENSORS HAVING A METALLIC FILL STRUCTURE

(71) Applicant: Robert Bosch GmbH, Stuttgart (DE)

(72) Inventors: Johannes Meyer, Ettlingen (DE); Juergen Seiz, Welzheim (DE); Martin Nezadal, Leonberg (DE); Maik Hansen, Leonberg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 364 days.

(21) Appl. No.: 17/272,149

(22) PCT Filed: Sep. 20, 2019

(86) PCT No.: PCT/EP2019/075429
§ 371 (c)(1),
(2) Date: Feb. 26, 2021

(87) PCT Pub. No.: WO2020/104084
PCT Pub. Date: May 28, 2020

(65) Prior Publication Data

US 2021/0328359 A1 Oct. 21, 2021

(30) Foreign Application Priority Data

Nov. 22, 2018 (DE) ..... 102018219986.8

(51) Int. Cl.
*H01Q 1/32* (2006.01)
*H01Q 21/00* (2006.01)
(Continued)

(52) U.S. Cl.
CPC ..... *H01Q 21/0093* (2013.01); *H01Q 1/3233* (2013.01); *H01Q 21/065* (2013.01); *H01Q 1/38* (2013.01)

(58) Field of Classification Search
CPC ..... H01Q 21/0093; H01Q 1/3233; H01Q 21/065; H01Q 1/38
See application file for complete search history.

(56) References Cited

U.S. PATENT DOCUMENTS

2018/0316098 A1 11/2018 Amadjikpe

FOREIGN PATENT DOCUMENTS

CN 102110884 A 6/2011
DE 68910677 T2 2/1994
(Continued)

OTHER PUBLICATIONS

International Search Report for PCT/EP2019/075429, dated Dec. 5, 2019.

*Primary Examiner* — Graham P Smith
(74) *Attorney, Agent, or Firm* — NORTON ROSE FULBRIGHT US LLP; Gerard Messina

(57) ABSTRACT

A circuit board for radar sensors including a substrate having a topside and a lower surface. The circuit board has at least one antenna device, which is situated on the topside of the substrate and is developed out of a metal layer. In addition, the circuit board has a fill structure situated on the topside of the substrate, which is developed out of the metal layer. The fill structure is situated at a distance from the antenna device in a surface region of the topside of the substrate, the surface region not being taken up by the antenna device. The fill structure has no electrical connection to the antenna device. The surface utilization of the fill structure amounts to between 50% and 300% of that of a surface utilization of the antenna device.

14 Claims, 3 Drawing Sheets

(51) Int. Cl.
*H01Q 21/06* (2006.01)
*H01Q 1/38* (2006.01)

(56) References Cited

FOREIGN PATENT DOCUMENTS

| | | | |
|---|---|---|---|
| DE | 102008000502 | A1 | 9/2009 |
| DE | 102014219432 | A1 | 3/2016 |
| DE | 102016119825 | A1 | 4/2018 |
| DE | 112016005738 | T5 | 10/2018 |
| JP | H04157905 | A | 5/1992 |
| JP | 2002344238 | A | 11/2002 |
| JP | 2004260554 | A | 9/2004 |
| JP | 2006352871 | A | 12/2006 |
| JP | 2007158707 | A | 6/2007 |
| JP | 2009239953 | A | 10/2009 |
| JP | 2013168875 | A | 8/2013 |
| JP | 2016039541 | A | 3/2016 |
| JP | 2016152590 | A | 8/2016 |
| JP | 2017152850 | A | 8/2017 |
| JP | 2017188779 | A | 10/2017 |
| KR | 20140109649 | A | 9/2014 |
| WO | 2017175835 | A1 | 10/2017 |

CIRCUIT BOARD FOR RADAR SENSORS HAVING A METALLIC FILL STRUCTURE, AND METHOD FOR PRODUCING A CIRCUIT BOARD FOR RADAR SENSORS HAVING A METALLIC FILL STRUCTURE

FIELD

The present invention relates to a circuit board for radar sensors having a metallic fill structure, and to a method for producing a circuit board for radar sensors having a metallic fill structure.

BACKGROUND INFORMATION

Conventional circuit boards for radar sensors are produced to include only the required metal structures for the sensor, e.g., radar sensors of the generations 1-4. With the aid of an optical system, a check of the production tolerances of the production process of the circuit board is carried out on the relevant structures such as the antenna, the circuit traces or the soldering surfaces. Optical camera systems, which can check the relevant structures only to a limited extent during the production on account of short process times, are generally used for this purpose.

The production process of the circuit board, in particular the etching process for developing the relevant structures, causes production tolerances among the relevant structures. The production tolerances result from the different placements of the relevant structures on the circuit board related to production requirements, which means that different amounts of material are removed from the circuit board during the etching process. In addition, vias are provided in order to electrically interconnect the underside and topside and components that are introduced there. The vias become electrically conductive again with the aid of a galvanic process through an epitaxial growth of copper at the vias.

In this context, in particular in the case of radar sensor circuit boards, because the relevant structures take up only a small share of the available space on the circuit board and the rest of the surface of the circuit board remains free, the problem arises that the galvanic epitaxial growth is not homogeneously distributed across the entire circuit board on account of the small quantity of copper on the circuit board.

This may cause different tolerances to develop on the circuit board. This changes the mechanical dimensions of the relevant structures such that, for instance, an epitaxial copper growth has a thicker or thinner development on surfaces of the circuit board. In addition, slanted edges of the relevant structures may have a round development or are not formed as required. If the metal component on the topside of the circuit board is too low, then the galvanic process will not distribute the copper in a uniform manner across the surface of the circuit board; instead, it may appear in concentrated form at a few places on the circuit board.

As illustrated in FIG. 5, the circuit board for radar sensors has only the antenna surfaces, very thin circuit traces, and the solder surfaces in order to provide an electrical connection to integrated components on the underside of the circuit board. The remaining surfaces on the circuit board are unutilized surfaces and not used or required for the functionality of the radar sensor. The result could be that the production processes used by the circuit board manufacturers for these circuit boards, in particular for use in radar sensors, do not provide the desired quality because they are optimized for circuit boards having a high copper component on the surface or for an even distribution of the copper on the surface.

Furthermore, after the metal structures have been etched, the surface of the circuit traces for the electrical connection of the antenna to the solder surfaces may end up smaller, that is to say, not as required, so that no electrical signal flow takes place between the antenna and the corresponding electronics in the worst case. Moreover, in a high-frequency component such as the radar sensor, greater noise may occur in the receiver, or the emission of the antenna may no longer take place in the desired direction. It is also disadvantageous if the circuit traces, which have a nominal width of 100 μm, for example, have a width of only 80 μm, the wave resistance is detuned and thus a different resistance value than required is present.

Circuit boards for use in radar sensors are described in German Patent Application No. DE 10 2016 119825 A1, for instance.

SUMMARY

The present invention provides a circuit board for radar sensors having a metallic fill structure, and a method for producing a circuit board for radar sensors having a metallic fill structure. In addition, the present invention provides a radar sensor.

The present invention provides a circuit board for radar sensors including a substrate having a topside and an underside. In accordance with an example embodiment of the present invention, the circuit board has at least one antenna device, which is situated on the topside of the substrate and developed out of a metal layer. The circuit board additionally has a fill structure, which is situated on the topside of the substrate and formed out of the metal layer. The fill structure is furthermore disposed at a distance from the antenna device in a surface region of the topside of the substrate that is not taken up by the antenna device. In addition, the fill structure has no electrical connection to the antenna device. Furthermore, a surface utilization by the fill structure amounts to between 50% to 300% of a surface utilization of the antenna device.

In addition, the present invention provides a method for producing a circuit board for radar sensors including a substrate having a topside and an underside. In accordance with an example embodiment of the present invention, the method includes a step of applying a fully continuous metal layer on a topside of a substrate. The present method also includes a further step of forming at least one antenna device situated on the topside of the substrate, and a fill structure which is developed out of the metal layer. In addition, the fill structure is situated at a distance from the antenna device in a surface region of the topside of the substrate that is not taken up by the antenna device. The fill structure furthermore has no electrical connection to the antenna device. In addition, a surface utilization of the fill structure amounts to between 50% to 300% of a surface utilization of the antenna device.

The antenna device is to be understood as the relevant structures for the circuit board of a radar sensor. The relevant structures include at least one antenna, which is connected via a circuit trace to a solder surface. With the aid of a via, an electrical connection is established to the monolithic microwave integrated circuit (MMIC) with supply and data lines, soldered to the topside of the circuit board. In an alternative embodiment, the monolithic microwave integrated circuit is soldered to the underside of the circuit board. For further antennas, corresponding additional structures have to be provided.

In an advantageous manner, the application of periodically situated metallic structures makes it possible both to increase the share of the metal surface on the circuit board, which is advantageous for optimizing the production process, and to carry out a check of the necessary accuracy of the production process.

In accordance with the present invention additional fill structures are applied on the surface of the circuit board in order to advantageously make the copper distribution more homogeneous during the galvanic process. This is advantageous insofar as a relatively uniform metallic image is now formed, preferably a copper image, instead of only thin circuit traces being present.

In addition, the fill structures are developed with the dimensions and the orientation of the antenna device or the antenna, the circuit traces and the solder surfaces, which means that a check of the etching tolerances, or their compliance, can advantageously take place on the metallic fill structures, which are preferably made of copper.

In addition, in accordance with an example embodiment of the present invention, it is advantageous that not only a few isolated surfaces such as the antenna but larger surfaces are developed out of the applied full copper surface after the copper has been etched, which makes it possible to carry out the etching process in a much more defined and optimized manner. This may result in a better quality with respect to the required manufacturing tolerances. Moreover, the copper is more optimally distributed in the vias during the galvanic process, and a more homogeneous distribution on the entire circuit board is brought about.

Preferred further refinements of the present invention are described herein.

According to one preferred embodiment of the present invention, the surface utilization of the fill structure amounts to between 75% and 200%, in particular to between 90% and 150% of the surface utilization of the antenna device. The surface utilization of the fill structure preferably amounts to 100% of the surface utilization of the antenna device.

It is advantageous for an optimal production process of the circuit board if metal, in particular metal structures, is/are formed as uniformly as possible on the surface of the circuit board. For this reason, the free surfaces of the circuit board not required for the technical function of the radar sensor or on which technical components for the technical function of the radar sensor are provided, are also covered with fill structures, in particular made of metal. However, solid metal surfaces have the disadvantage that a check of the production tolerances on full metal surfaces is impossible. It is therefore advantageous to provide the free surface with periodic fill structures, which are set apart and have dimensions on the order of magnitude of the antenna device. A check of the production tolerances, in particular an optical check, is simplified and becomes more accurate, and the epitaxial growth of copper in the further production process of the circuit board takes place more homogeneously on the entire circuit board.

According to one preferred embodiment of the present invention, the at least one fill structure is developed in a rectangular or square shape.

Rectangular or square shapes have the advantage that a regular grid is able to be formed by these shapes and that they are easier to realize on the order of magnitude of the antenna device on the other hand. The production process of the circuit board is improved, in particular the etching and the copper application.

According to one preferred embodiment of the present invention, the rectangular or square shape of the fill structure and the antenna device have edges, and the edges of the fill structure extend with the same orientation as the edges of the antenna device.

This embodiment is advantageous insofar as the edges of the rectangular or square shape are able to be positioned with the same orientation as the antenna device and thus are subject to the same error tolerances as the antenna device. A check of the error tolerances is therefore improved.

According to one preferred embodiment of the present invention, a multitude of fill structures is situated in a grid with a different orientation and different clearances.

This embodiment is advantageous insofar as the metal surface is uniformly distributed on the circuit board on account of the multitude of fill structures and the antenna device, with the result that the required tolerances in the production process of the circuit board are able to be better satisfied. This is particularly advantageous in the galvanization step. The copper application on the circuit board is carried out more homogeneously. In addition, a check of the production tolerances of the production process is able to be improved due to the large-area surface distribution of the fill structures.

According to one preferred embodiment of the present invention, the clearances between the fill structures amount to between 50% and 200%, in particular to 75% and 150% of the antenna device. The clearances between the fill structures preferably have a clearance of 100% of the clearance of the antenna device.

In an advantageous manner, the clearances of the rectangular or square fill structures correspond to the clearances of the antenna device, which means that the fill structures have the same production tolerances as the antenna device. The check of the production tolerances is therefore able to be carried out more effectively and optimally.

According to one preferred embodiment of the present invention, the antenna device and the metallic fill structure are made of copper.

BRIEF DESCRIPTION OF THE DRAWINGS

Identical or functionally equivalent elements in the figures have been provided with the same reference numerals.

DETAILED DESCRIPTION OF EXAMPLE EMBODIMENTS

Figure 1:
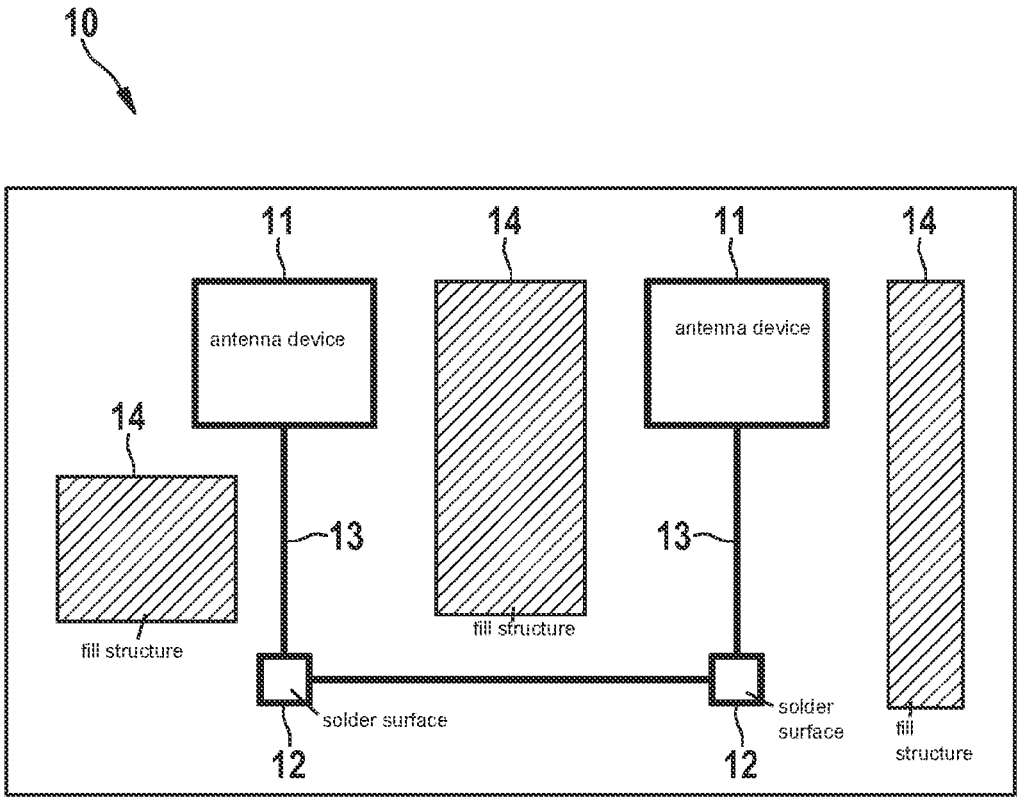
FIG. 1 shows a schematic illustration of the circuit board according to a first example embodiment of the present invention.

FIG. 1 shows a schematic illustration of circuit board 10 according to a first embodiment of the present invention.

Reference numeral 10 in FIG. 1 denotes a circuit board according to the present invention. Circuit board 10 includes a substrate 1 having a topside 4 and an underside 3. At least one antenna device 11 is developed on topside 4 of substrate 1. In one embodiment, antenna device 11 has two antennas. Antenna device 11 is developed out of a metal layer 2, preferably from copper. Antenna device 11 includes the antenna, circuit trace 13, and solder surface 12. Circuit trace 13 connects the antenna to solder surface 12. By way of vias in solder surface 12, a monolithic microwave integrated circuit (MMIC) is able to be connected to the antenna by way of circuit trace 13. In one preferred embodiment, the MMIC is situated on the side of topside 4 of substrate 1 (not shown). In an alternative embodiment, the MMIC is disposed on underside 3 of substrate 1.

In the embodiment of the present invention, fill structures 14 are situated on topside 4 of substrate 1. Fill structures 14 are set apart from antenna device 11 and situated in a surface region of topside 4 of substrate 1 not taken up by antenna device 11. Fill structure 14 has no electrical connection to antenna device 11. In one advantageous embodiment, the surface utilization of fill structure 14 amounts to a between 50 and 300% of a surface utilization of antenna device 11.

FIG. 1 shows an embodiment of circuit board 10 of a radar sensor in which three fill structures 14 are formed. It is advantageous for an optimal production process if the circuit board surface is covered with metal as uniformly as possible. The free surfaces of circuit board 1 are therefore occupied by periodic fill structures 14 having dimensions on the order of magnitude of antenna device 11. FIG. 1 is an exemplary representation of the present invention which, however, does not restrict the present invention. It is furthermore possible that a multitude of fill structures 14 is formed on topside 4 of substrate 1.

Fill structures 14 may be embodied in the shape of rectangles or squares. In an advantageous manner, fill structures 14 are able to be placed in a regular grid. The edges of rectangular or square fill structures 14 are placed with the same orientation as the edges of the antenna device. Therefore, the edges of fill structures 14 are advantageously subject to the same production tolerances as the antenna device, which improves a check of the production tolerances. In one example embodiment of the present invention, the clearances between the rectangular and square fill structures 14 are on the order of magnitude of antenna device 11.

Figure 2:
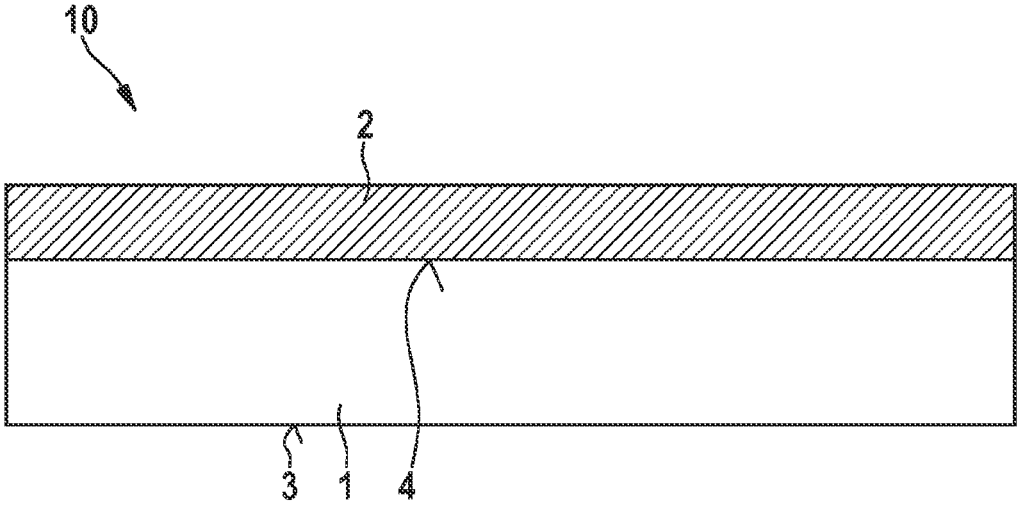
FIG. 2 shows a schematic illustration of a circuit board in a cross-sectional view without developed metal structures and fill structures.

FIG. 2 is a schematic representation of a circuit board in a cross-sectional view without developed metal structures and fill structures.

Reference numeral 10 in FIG. 2 denotes a circuit board according to the present invention. Circuit board 10 includes a substrate 1 having an underside 3 and a topside 4. Metal layer 2 is formed on topside 4. From metal layer 2, antenna device 11, including at least one antenna, circuit traces and solder surfaces, as well as fill structures 14 is formed out of metal layer 2. Metal layer 2 preferably includes copper.

Figure 3:
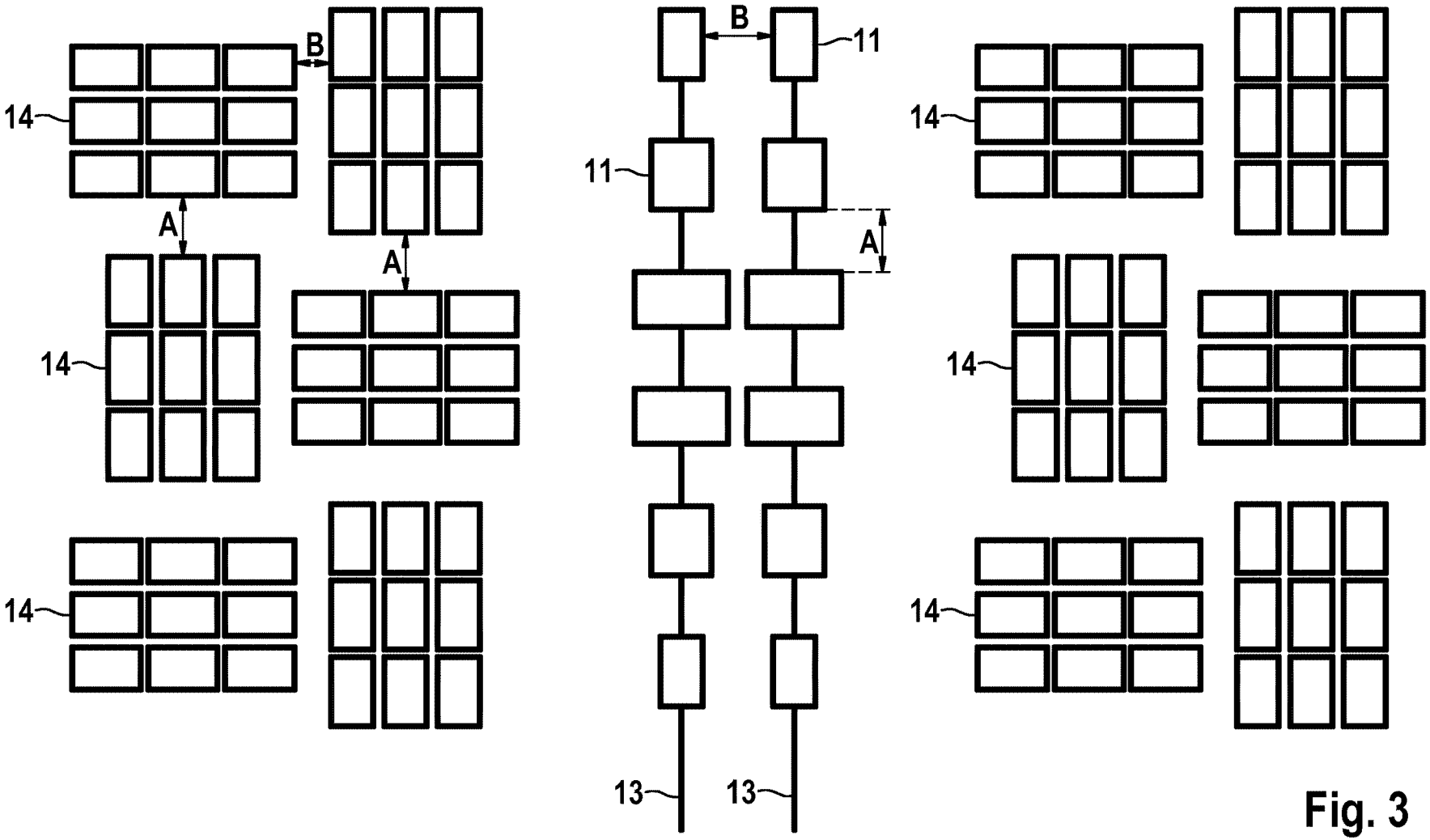
FIG. 3 shows a schematic illustration of the circuit board with fill structures placed in a grid according to a second example embodiment of the present invention.

FIG. 3 is a schematic representation of the circuit board including fill structures 14 situated in the grid according to a second embodiment of the present invention.

FIG. 3 shows an antenna array having two antenna devices 11. Antenna device 11 has antennas and circuit traces 13. Antenna device 11 is formed out of a metal layer 2, preferably copper. Antenna device 11 has clearances A and B. In FIG. 3, fill structures 14 having dimensions on the order of magnitude of antenna device 11 are shown. The antennas of antenna devices 11 have a clearance B with respect to each other. Individual fill structures 14 of the fill structures situated in a grid have the same clearance B relative to one another. By developing the same clearance, the etching process on the fill structures on circuit board 1 is carried out in the same way as on antenna device 11. Fill structures 14 have a rectangular or square shape. A multitude of fill structures 14 is situated in groups of fill structures 14. This offers the advantage that the surface utilization of fill structure 14 corresponds to the surface utilization of antenna device 11. If fill structures 14 are all uniformly aligned in a perpendicular fashion in the ideal case, then this results in a considerably greater surface utilization for fill structures 14 than for antenna device 11. The alternating horizontal and vertical placement of fill structures 14 in a grid produces a balanced surface ratio. In an advantageous manner, the entire production process including the etching and copper application is therefore improved. In addition, the regular placement of fill structures 14 in a grid makes it possible for an optical system to check the grid including the periodic placement of the fill structures.

Figure 4:
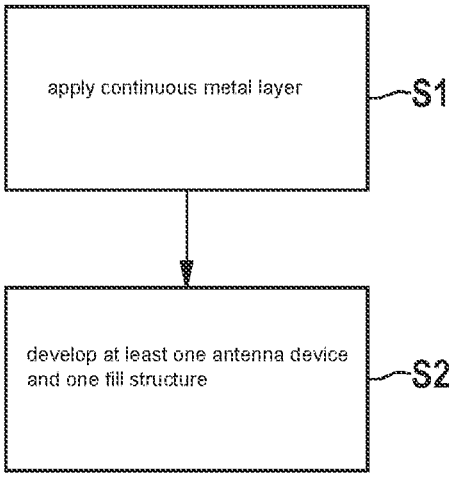
FIG. 4 shows a schematic illustration to describe a method for producing a circuit board for radar sensors having a metallic fill structure according to the first example embodiment of the present invention.
Figure 5:
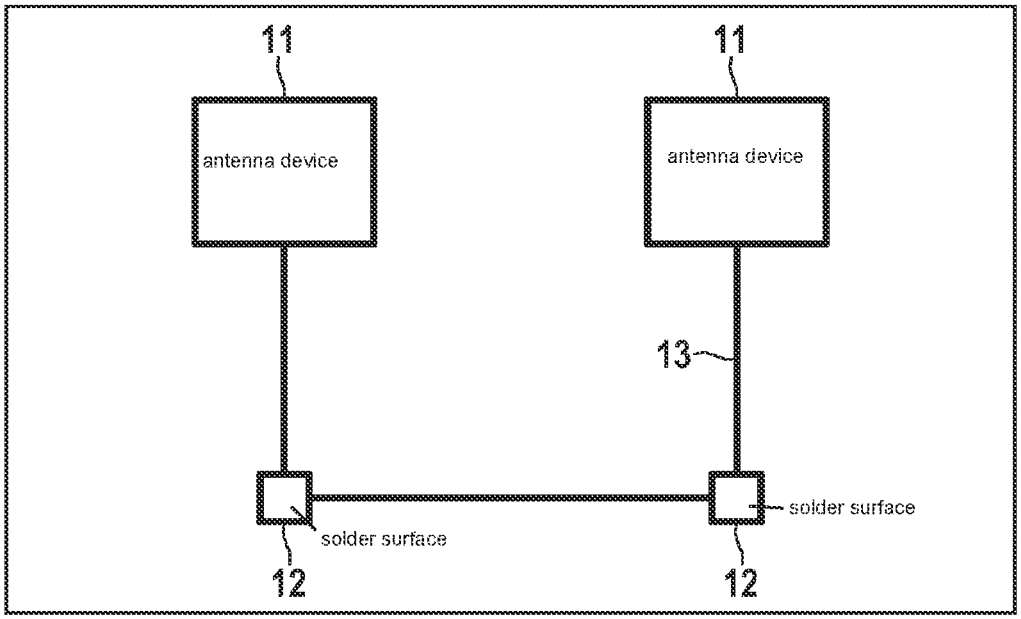
FIG. 5 shows a schematic illustration of an exemplary circuit board for radar sensors.

FIG. 4 shows a schematic representation in order to describe a method for producing a circuit board for radar sensors having a metallic fill structure according to the first embodiment of the present invention.

In a first step S1, a fully continuous metal layer 2 is applied to a topside 4 of substrate 1. Metallic layer 2 is preferably made of copper. In a further step S2, at least one antenna device 11 and a fill structure 14 are developed on the topside of substrate 1. Antenna device 11 and fill structure 14 are developed out of metal layer 2. In addition, fill structure 14 is situated in a surface region of topside 4 of substrate 1 at a distance from antenna device 11. The surface region is an area on topside 4 of substrate 1 that is not taken up by antenna device 11. Antenna device 11 includes at least one antenna, at least one circuit trace 13, and at least one solder surface 12. The antenna of antenna device 11 and solder surface 12 are electrically connected by circuit trace 13. Solder surface 12 may have vias for the electrical connection of a monolithic microwave integrated circuit to antenna device 11. Fill structure 14 situated on topside 4 of substrate 1 has no electrical connection to antenna device 11. The surface utilization of fill structure 14 amounts to between 50% and 300% of the surface utilization of antenna device 11.

The method of the present invention optimizes the production process of circuit board 1, in particular the step of etching antenna device 11 and fill structures 14 out of continuous metal layer 2. In addition, the copper application takes place more homogeneously because a greater copper share is included on circuit board 1 because of fill structures 14, and the copper distributes itself more optimally on the plurality of structures, in particular the fill structures, or grows uniformly in an epitaxial manner.

What is claimed is:

1. A circuit board for a radar sensor, comprising:

a substrate having a topside and an underside;

at least one antenna device situated on the topside of the substrate and developed out of a metal layer; and a fill structure situated on the topside of the substrate, the fill structure being developed out of the metal layer, and the fill structure being situated at a distance from the antenna device in a surface region of the topside of the substrate that is not taken up by the antenna device;

wherein the fill structure has no electrical connection to the antenna device, and wherein a surface utilization of the fill structure amounting to between 50% and 300% of a surface utilization of the antenna device.

2. The circuit board as recited in claim 1, wherein the surface utilization of the fill structure amounts to between 75% and 200% of that of the surface utilization of the antenna device.

3. The circuit board as recited in claim 1, wherein the surface utilization of the fill structure amounts to between 90% and 150% of that of the surface utilization of the antenna device.

4. The circuit board as recited in claim 1, wherein the surface utilization of the fill structure has 100% of the surface utilization of the antenna device.

5. The circuit board as recited in claim 1, wherein the fill structure is developed in a rectangular or square shape.

6. The circuit board as recited in claim 5, wherein the rectangular or square shape of the fill structure and the antenna device have edges, and the edges of the fill structure extend with a same orientation as the edges of the antenna device.

7. The circuit board as recited in claim 5, wherein the fill structure includes a multitude of fill structures situated in a grid with a different orientation and clearances.

8. The circuit board as recited in claim 7, wherein the clearances between the fill structures amount to between 50% and 200% of a clearance of the antenna device.

9. The circuit board as recited in claim 7, wherein the clearances between the fill structures amount to between 75% and 150% of a clearance of the antenna device.

10. The circuit board as recited in claim 7, wherein the clearances between the fill structures have a clearance of 100% of a clearance of the antenna device.

11. A method for producing a circuit board for a radar sensor including a substrate having a topside and an underside, the method comprising the following steps:

applying a fully continuous metal layer on the topside of a substrate; and developing at least one antenna device situated on the topside of the substrate, and a fill structure, the antenna device and the fill structure being developed out of the metal layer, wherein the fill structure is situated at a distance from the antenna device in a surface region of the topside of the substrate that is not taken up by the antenna device;

wherein the fill structure has no electrical connection to the antenna device; and wherein a surface utilization of the fill structure amounts to between 50% and 300% of that of a surface utilization of the antenna device.

12. The method as recited in claim 11, wherein the fill structure is developed in a rectangular or square shape.

13. The method as recited in claim 12, wherein the rectangular or square shape of the fill structure and the antenna device have edges, and the edges of the fill structure extend with a same orientation as the edges of the antenna device.

14. A radar sensor, comprising:

a circuit board including:

a substrate having a topside and an underside;

at least one antenna device situated on the topside of the substrate and developed out of a metal layer; and a fill structure situated on the topside of the substrate, which is developed out of the metal layer, the fill structure being situated at a distance from the antenna device in a surface region of the topside of the substrate that is not taken up by the antenna device;

wherein the fill structure has no electrical connection to the antenna device, and wherein a surface utilization of the fill structure amounting to between 50% and 300% of a surface utilization of the antenna device.

* * * * *